US005481444A

United States Patent [19]

Schultz

[11] Patent Number: 5,481,444

[45] Date of Patent: Jan. 2, 1996

[54] MINIATURE LIGHT HOLDER

[76] Inventor: Thomas J. Schultz, W1633 Aerotech Dr., Appleton, Wis. 54915

[21] Appl. No.: 197,144

[22] Filed: Feb. 16, 1994

[51] Int. Cl.[6] ..... F21P 1/02

[52] U.S. Cl. ..... 362/249; 362/396; 362/123; 362/391; 248/229.16; 439/699.1; 439/463; 439/453; 439/575

[58] Field of Search ..... 362/806, 396, 362/249, 391, 123, 392; 439/699, 506, 502, 505, 419, 558, 452, 575, 453, 463; 248/319, 224.3, 229, 231.8, 316.7; D26/138, 25, 113, 140; D8/395, 373

[56] References Cited

U.S. PATENT DOCUMENTS

| | | | |
|---|---|---|---|
| D. 178,832 | 9/1956 | Giorklint | D29/1 |
| D. 297,616 | 9/1988 | Doty et al. | D8/395 |
| 1,625,248 | 4/1927 | Eckstein . | |
| 1,895,656 | 1/1933 | Gadke . | |
| 1,980,948 | 11/1934 | Abramson . | |
| 2,077,107 | 4/1937 | Grundman | 362/392 X |
| 2,253,164 | 8/1941 | Benander | 362/391 X |
| 2,299,733 | 10/1942 | Benander | 173/358 |
| 2,453,695 | 11/1948 | Belling | 362/806 X |
| 3,189,310 | 6/1965 | Trueson | 362/246 X |
| 3,540,687 | 11/1970 | Cuva | 248/316 |
| 3,678,443 | 7/1972 | Koehler | 339/119 |
| 4,903,177 | 2/1990 | Warning | 362/806 X |
| 4,969,071 | 11/1990 | Van Elk | 362/249 |
| 5,037,324 | 8/1991 | Schoffey, Sr. | 439/452 |

FOREIGN PATENT DOCUMENTS

| | | | |
|---|---|---|---|
| 2053358 | 4/1979 | Canada | 248/214 |

*Primary Examiner*—Ira S. Lazarus
*Assistant Examiner*—Thomas M. Sember
*Attorney, Agent, or Firm*—Nilles & Nilles

[57] ABSTRACT

A light holder includes a receptacle which receives a miniature light without requiring the imposition of significant application forces by the user during insertion and which thus permits miniature lights to be strung on a christmas tree or the like in a desired orientation without fear of damaging the lights or the holders. The receptacle may have a body which slidably receives a socket of a stock light, in which case the receptacle body should be formed with slots for guiding the electrical cord of the light string into and through the receptacle. The receptacle may also be formed integral with a light socket when the light is manufactured. In either case, the receptacle and a clip for clipping the holder to a support are preferably formed from a single injection molded element.

4 Claims, 2 Drawing Sheets

MINIATURE LIGHT HOLDER

BACKGROUND OF THE INVENTION

1. Field of the Invention

The invention relates to light holders and, more particularly, relates to holders for miniature decorative lights usable on christmas trees or the like and to strings of miniature lights using such holders.

2. Discussion of Related Art

Decorative lights are well known and are typically used for ornamental purposes, particularly as indoor and/or outdoor christmas tree decorations. Decorative lights typically come in one of three sizes, two of which have relatively large bulbs threaded into sockets connected by electrical cords, and the third of which has bulbs which are much smaller (commonly known as "miniature lights"). The larger lights are relatively heavy and, if not clipped onto the tree or another support, may be difficult to hold in position when strung. These relatively large lights are often sold with integral alligator clips or the like to permit the lights to be clipped to an underlying support, thus maintaining them in position.

Miniature lights typically comprise a cord, a plurality of relatively small sockets, and a plurality of miniature bulbs plugged into the sockets. Miniature lights are relatively lightweight and, unlike their larger counterparts, are sold without clips, holders, or any other devices for attachment to an underlying support because it is generally thought that the miniature lights will remain in place without such attachment. Miniature lights must therefore be strung with the bulbs in a random orientation. This is undesirable to many people who prefer that lights be strung with all bulbs in a single, typically vertical, orientation.

Proposals have been made to permit the positive attachment of miniature lights to underlying supports such as the branches of a christmas tree. For instance, Design U.S. Pat. No. Des. 297,616 to Doty et al. (the Doty patent) proposes a clip having a lower V-clip member for attaching the clip to a support such as a tree branch, and an upper C-clip member for receiving the socket of a miniature light. The clip proposed by the Doty patent requires that the C-clip member grasp the light socket with sufficient forces to clamp the light in position. This in turn requires that the socket by snapped into the C-clip portion with considerable forces which, if improperly applied, may damage the clip, socket, bulb, or cord, thus destroying the clip or the light string or even creating a short circuit causing a fire hazard. Attempts to insert larger lights into the clips may also break the clips and/or damage the larger lights. Moreover, the clip proposed by the Doty patent lacks any device for guiding the cord either during the light insertion process or after insertion.

OBJECTS AND SUMMARY OF THE INVENTION

It is therefore an object of the invention to provide a light holder for a miniature decorative light which permits miniature lights to be attached to an underling support such as a christmas tree branch.

Another object of the invention is to provide a light holder for miniature lights which does not require the imposition of significant application forces to insert the light in the holder and which therefore inhibits damage to either the holder or the lights during the insertion process.

In accordance with a first aspect of the invention, these objects are achieved by providing a holder for a miniature light which includes a receptacle and a clip. The receptacle has a base and a generally tubular body extending from the base. The body has an inside diameter which is significantly larger than the diameter of a miniature light socket, thereby permitting relatively loose insertion of the light socket into the receptacle. The clip extends from the base of the receptacle and is designed for attaching the holder to a support such as a christmas tree branch.

Another object of the invention is to provide a light holder which has one or more of the attributes discussed above and which guides the electrical cord of a light string both during and after a light insertion process.

In accordance with another aspect of the invention, this object is achieved by providing the body of the receptacle with axial slots formed therein for the passage of an electrical cord therethrough. These slots preferably 1) are enlarged at their inner ends to accommodate the cord upon full insertion of the light into the holder, and/or 2) flare outwardly at their outer ends to guide the cord into the slots upon initial insertion of the light into the holder.

Yet another object of the invention is to provide a light holder which has one or more of the attributes discussed above and which is inexpensive to manufacture.

In accordance with still another aspect of the invention, this object is achieved by forming the receptacle and the clip as an integral injection molded element.

Still another object of the invention is to provide a string of miniature lights incorporating light holders having one or more of the attributes discussed above.

In accordance with yet another aspect of the invention, this object is achieved by providing a light string in combination with a plurality of holders. The light string includes a plurality of miniature lights and an electrical cord interconnecting the lights. Each of the lights comprises a socket connected to the cord and a bulb extending from the socket. Each of the holders supports a respective one of the lights and includes 1) a receptacle including a base, and 2) a clip, extending from a bottom surface of the base, for attaching the holder to a support.

In order to permit the holders to receive previously manufactured lights, each of the receptacles may further include a generally tubular body extending from the base and having an inside diameter which is significantly larger than the diameter of the sockets, thereby permitting relatively loose insertion of the light sockets into the receptacles. In this case, the body of each of the receptacles should have axial slots formed therein for the passage of an electrical cord therethrough.

The holders could also be formed with the light string during the manufacturing process, in which case each of the receptacles is non-detachably connected to a respective one of the sockets. Preferably, each of the receptacles is formed integral with the respective one of said sockets as a single injection molded element.

BRIEF DESCRIPTION OF THE DRAWINGS

Preferred exemplary embodiments of the invention are illustrated in the accompanying drawings in which like reference numerals represent like parts throughout and in which.

DETAILED DESCRIPTION OF THE PREFERRED EMBODIMENTS

1. Resume

Figure 1:
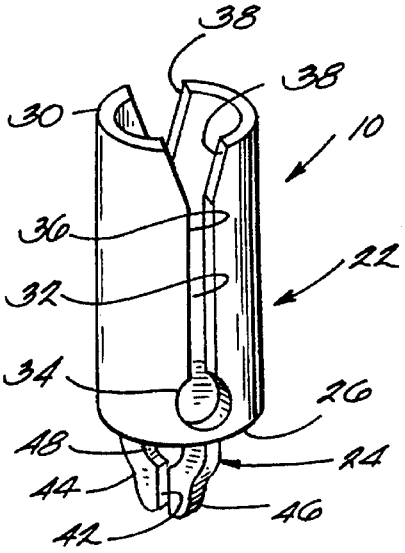
FIG. 1 is a perspective view of a miniature light holder constructed in accordance with a preferred embodiment of the invention.
Figure 4:
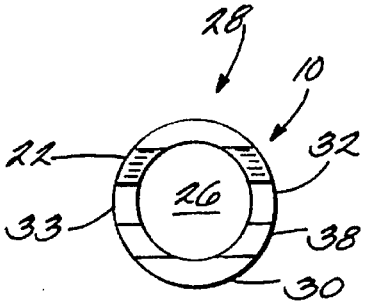
FIG. 4 is a top plan view of the light holder of FIGS. 1–3.
Figure 2:
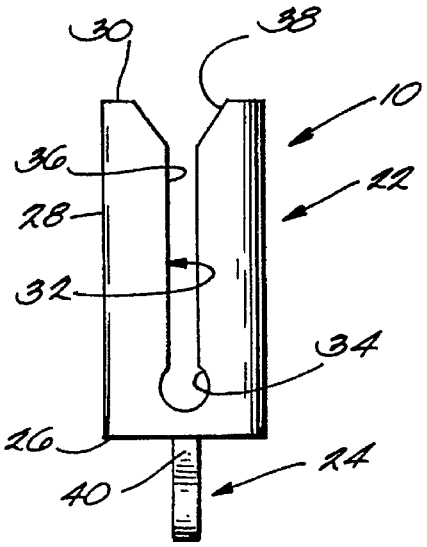
FIG. 2 is a side elevation view of the light holder of FIG. 1.
Figure 3:
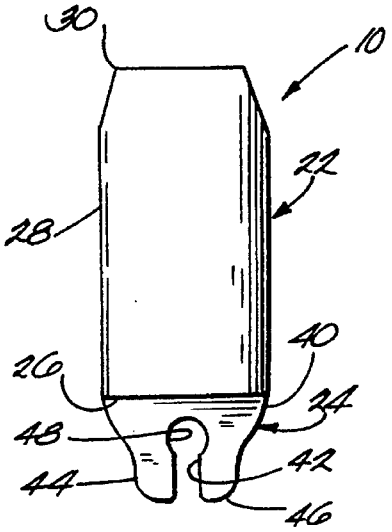
FIG. 3 is a front elevation view of the light holder of FIGS. 1 and 2.
Figure 5:
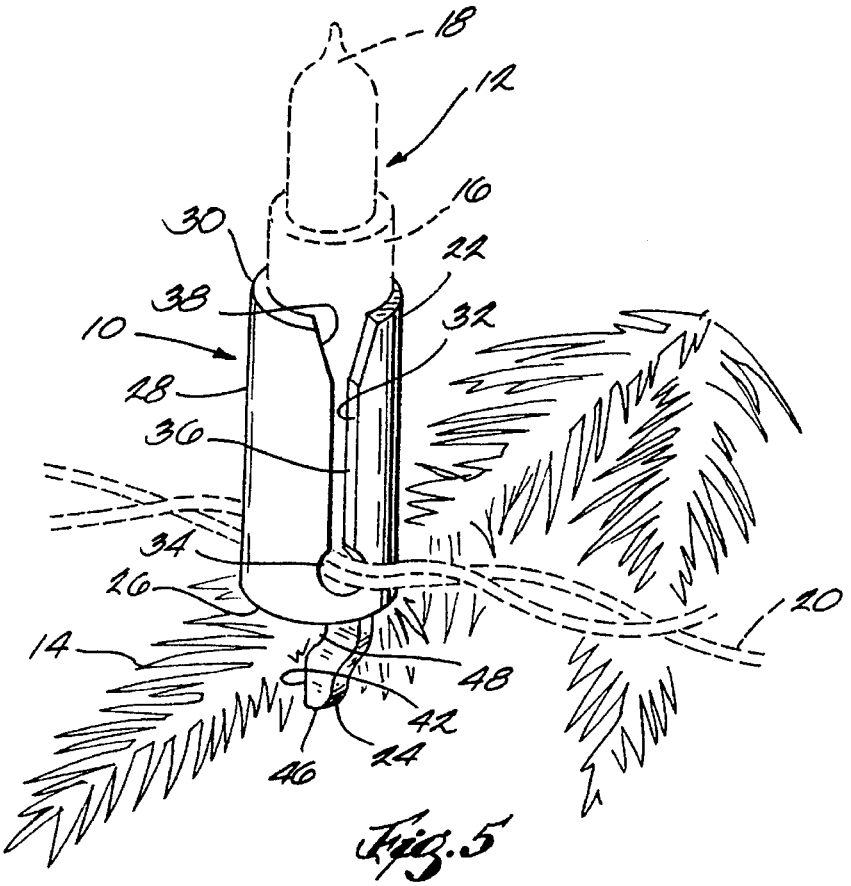
FIG. 5 is a perspective view of the light holder of FIGS. 1–4, illustrating the holder clipped to a christmas tree branch and receiving a miniature light.

Pursuant to the invention, a light holder is provided which includes a receptacle which receives a miniature light without requiring the imposition of significant application forces by the user during insertion or removal and which thus permits miniature lights to be strung on a christmas tree or the like in a desired orientation without fear of damaging the lights or the holders. The receptacle may have a body which slidably receives a socket of a stock light, in which case the receptacle body should be formed with a slot for guiding the electrical cord of the light string into and through the receptacle. The receptacle may also be formed integral with a light socket when the light is manufactured. In either case, the receptacle and a clip for clipping the holder to a support are preferably formed from a single injection molded element.

2. Construction and Operation of First Embodiment

Referring now to FIGS. 1–5, light holders 10 (only one of which is illustrated) are provided for mounting a string of miniature lights 12 on a christmas tree branch 14 or the like. The string of miniature lights 12 is conventional with each socket 16 being connected to the cord 20 and with each bulb 18 being plugged into a corresponding socket 16 as to make electrical contact with the wires of the cord 20. Each socket 16 has a diameter of about 0.25", which is industry standard for such lights. Each holder 10 is designed to receive a corresponding light 12 such that the socket 16 is slidably received in the holder 10 and the bulb 18 extends beyond the holder 10 at a designated orientation determined by the orientation of the holder 10. The holder 10 also receives and guides the electrical cord 20 of the light string as detailed below.

Each holder 10 includes a receptacle 22 for slidably receiving a light socket 16, and a clip 24 for clipping the holder 10 to the support 14. The receptacle 22 and clip 24 are preferably formed integrally as a single injection molded plastic element, thus minimizing production costs and eliminating assembly costs.

Each receptacle 22 comprises a base 26 and a tubular body 28 extending from the base 26 and terminating in an annular end 30. The illustrated body 28 has an annular cross-section, but bodies of other cross-sections could be employed as required to accommodate particular sockets. Body 28 should have an inside diameter which is significantly larger than the diameter of the sockets 16 so as to permit relatively loose insertion of a socket 16 into the receptacle 22. In the illustrated embodiment in which the sockets 16 have a diameter of about 0.25", the body 28 of receptacle 22 should have an inside diameter of 0.30".

Body 28 also has opposed elongated axial slots 32 formed therein for guiding the cord 20 during insertion of the light 12 into the receptacle 22 and for supporting and protecting the cord 20 following insertion. Each slot 32 has an enlarged rounded inner end portion 34 for receiving the cord 20 without twisting or pinching, a relatively long central portion 36 of generally constant width, and an outwardly flared outer portion 38 terminating at the outer end 30 of the body 28. The rounded inner portion 34 serves to protect the cord 70 as detailed below. The enlarged radius is not essential, however, and could be eliminated to facilitate molding. The flared end portion 38 of each of the slots 32 guides the cord 20 during insertion of the light 12 as detailed below.

Clip 24 of each of the holders 10 could extend in any desired direction from the receptacle 22 and, in the illustrated embodiment, extends axially from the bottom surface of the base 26. The clip 24 is designed for attachment to a branch of a designated size. Holders with clips of different sizes are preferably packaged and sold together so as to permit the holders for a given light string to be supported on both large and small branches 14. Clip 24 is preferably formed from a unitary plate member 40 having a slot 42 formed therein to define two opposed end jaws 44, 46. Jaws 44, 46 are relatively rigid but may be spread apart as required to accommodate a tree branch 14 in the slot 42 formed therebetween. Slot 42 preferably is enlarged at an inner end 48 thereof so as to form a receptacle for branch 14.

In use, the clips 24 of a plurality of holders 10 are clipped to supports such as the branches 14 of a christmas tree, and the sockets 16 of a like plurality of lights 12 are inserted into the receptacles 22 of the holders 10 such that the bottoms of the sockets 16 rest on the bases 26 of the receptacles 22. This insertion requires little effort due to the difference between the outer diameter of the sockets 16 and the inner diameter of the receptacle bodies 28. Insertion is also facilitated by the flared outer end portions 38 of slots 32 which serve to guide the cord 20 into the slots 32 at the beginning of the insertion process. Insertion can be facilitated still further by dimensioning each of the receptacle body 28 such that a portion of a corresponding socket 16 extends beyond the ends of body 28 after insertion, permitting the user to grasp the relatively sturdy socket 16 rather than the relatively fragile bulb 18. Damage to the lights 12, holders 10, and cord 20 is thus inhibited during insertion. Damage to the lights 12 and holders 10 is further inhibited by virtue of the fact that it is unlikely that one would try to force a larger light socket into the receptacle 22 since nearly anyone could readily see that the differences in diameters between the large socket and the small receptacle would render such insertion impossible. Damage to the cord 20 is still further inhibited by virtue of the fact that the cord 20 extends through the enlarged inner ends 34 of slots 32 when the socket 16 is fully inserted into the receptacle 22, thereby permitting substantial movement of the cord 20 with respect to the holder 10 without binding or pinching.

The lights 12 are maintained in the desired orientation after insertion due to the fact that the holders 10 are securely clipped to the branches 14. The holders 10 also tend to protect the lights 12 by substantially surrounding and thus encasing the sockets 16 (particularly the sensitive junction between the cord 20 and the sockets 16) within the receptacle 22. However, the light string can be unstrung with little effort simply by pulling the sockets 16 out of the receptacles 22 and by subsequently unclipping the clips 24 of the holders 10 from the branches 14.

The holder 10 described above is designed for use with existing light strings manufactured without holders. Holders could, however, be formed integral with the light sockets in order to eliminate insertion and removal of the lights from the holders. One such holder will now be described.

3. Construction and Operation of Second Embodiment

Figure 6:
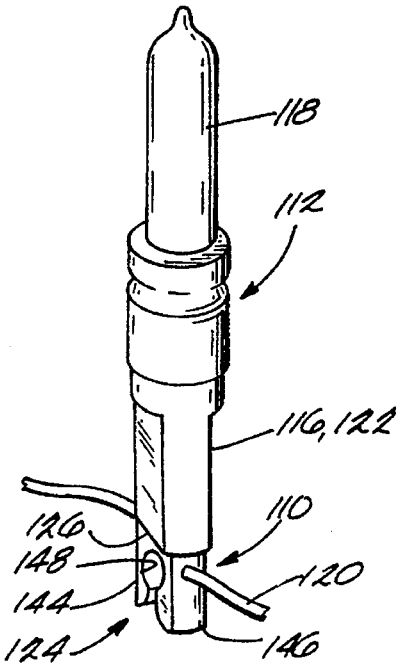
FIG. 6 is a perspective view of a miniature light and a light holder constructed in accordance with a second preferred embodiment of the invention.
Figure 7:
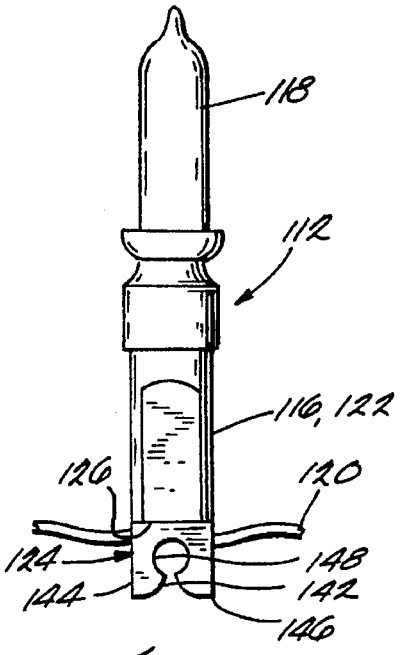
FIG. 7 is a front elevation view of the light and light holder of FIG. 6.

Referring now to FIGS. 6 and 7, a light holder 110 is illustrated and, when used in conjunction with other holders of like construction, is designed for mounting a string of miniature lights 112 on christmas tree branches or the like. The holder 110, like the holder 10 described above, is designed to receive a miniature light 112 so as to maintain the light at a designated orientation determined by the orientation of the holder 110. Since holder 110 includes many of the same features as holder 10, elements of holder 110 corresponding to those of holder 10 are designated by the same reference numeral, incremented by 100, and will not be described in detail.

Holder 110 differs from holder 10 of the first embodiment primarily in that the body of the receptacle is eliminated and in that the base 126 is formed integral with the socket 116 of the light 112. The socket 116 and holder 110 including the receptacle base 126 and clip 124 are formed from a unitary injection molded plastic element. A user can thus clip the miniature light 112 directly to a tree branch or the like without having to insert the light into the receptacle of a holder.

Many changes and modifications could be made to the invention without departing from the spirit thereof. The scope of such changes and modifications can be understood from the appended claims.

What is claimed is:

1. A holder for a miniature light including a light socket and a bulb removably inserted into said light socket, said holder comprising:

A. a receptacle having a base and a generally tubular body extending upwardly from said base, said body having a minimum inside diameter which is significantly larger than a maximum outside diameter of said light socket, thereby permitting relatively loose insertion of said light socket into and removal of said light socket from said receptacle, wherein said body of said receptacle has upwardly extending axial slots formed therein for the passage of an electrical cord therethrough, and wherein said slots have upper ends which flare outwardly; and B. a clip, extending downwardly from said base of said receptacle, for attaching said holder to a support, said clip being formed from a unitary plate member having a slot formed therein to define a pair of opposed jaws, wherein said clip and said receptacle are formed as a unitary injection molded element.

2. A holder as defined in claim 1, wherein said slot in said clip has an upper end which flares outwardly.

3. An apparatus comprising

A. a light string comprising a plurality of miniature lights and an electrical cord interconnecting said lights, each of said lights comprising a light socket connected to said cord and a bulb extending from said light socket; and B. a plurality of holders, each of which supports a respective one of said lights, each of said holders including 1. a receptacle having a base and a generally tubular body extending upwardly from said base, said body having a minimum inside diameter which is significantly larger than a maximum outside diameter of said light sockets, thereby permitting relatively loose insertion of said light sockets into and removal of said light sockets from said receptacles, wherein said body of each said receptacle has upwardly extending axial slots formed therein for the passage of said electrical cord therethrough, and wherein said slots of each said receptacle have upper ends which flare outwardly; and 2. a clip, extending downwardly from a bottom surface of said receptacle, for attaching said holder to a support, said clip being formed from a unitary plate member having a slot formed therein to define a pair of opposed jaws, wherein said clip and said receptacle are formed as a unitary injection molded element.

4. An apparatus as defined in claim 3, wherein the slot in each of said clips has an upper end which flares outwardly.

* * * * *